US008794686B2

(12) United States Patent
Grieve

(10) Patent No.: US 8,794,686 B2
(45) Date of Patent: Aug. 5, 2014

(54) TRAY AND DEVICE FOR STABILISING A TRAY

(75) Inventor: Alison Grieve, Edinburgh (GB)

(73) Assignee: Safetray Products Limited, Edinburgh (GB)

( * ) Notice: Subject to any disclaimer, the term of this patent is extended or adjusted under 35 U.S.C. 154(b) by 0 days.

(21) Appl. No.: 13/582,729

(22) PCT Filed: Mar. 1, 2011

(86) PCT No.: PCT/GB2011/050402
§ 371 (c)(1), (2), (4) Date: Nov. 11, 2012

(87) PCT Pub. No.: WO2011/107786
PCT Pub. Date: Sep. 9, 2011

(65) Prior Publication Data

US 2013/0057005 A1 Mar. 7, 2013

(30) Foreign Application Priority Data

Mar. 2, 2010 (GB) ..... 1003446.0

(51) Int. Cl.
*B65D 1/34* (2006.01)
*A47G 23/06* (2006.01)

(52) U.S. Cl.
USPC ..... 294/172; 206/557

(58) Field of Classification Search
USPC ..... 294/25, 144, 168, 169, 172; 206/557; 220/574, 575
See application file for complete search history.

(56) References Cited

U.S. PATENT DOCUMENTS

| | | | | | |
|---|---|---|---|---|---|
| 219,183 | A | * | 9/1879 | Tait | 294/144 |
| 2,723,068 | A | | 11/1955 | Ettwein | |
| 3,315,858 | A | * | 4/1967 | Horner | 294/143 |
| 3,504,832 | A | * | 4/1970 | Corvetti | 294/144 |
| 3,941,286 | A | * | 3/1976 | Perkinson | 294/172 |
| 4,746,057 | A | | 5/1988 | Wagner | |
| 5,076,438 | A | * | 12/1991 | Aronson | 206/557 |
| 5,353,952 | A | * | 10/1994 | Donche | 220/575 |
| 5,425,455 | A | * | 6/1995 | Miller et al. | 206/562 |
| 8,272,512 | B2 | * | 9/2012 | Joseph | 206/563 |
| 2006/0032780 | A1 | | 2/2006 | Heyn | |
| 2011/0031158 | A1 | * | 2/2011 | King | 206/557 |

FOREIGN PATENT DOCUMENTS

| | | | |
|---|---|---|---|
| GB | 2266447 | A | 11/1993 |
| JP | 54-067091 | U | 5/1979 |
| NL | 1027855 | C2 | 6/2006 |
| WO | WO 2006/008147 | A2 | 1/2006 |

OTHER PUBLICATIONS

International Search Report and Written Opinion dated May 27, 2011 from PCT/GB2011/050402.
GB Search Report dated Jun. 1, 2010 from GB1003446.0.

* cited by examiner

*Primary Examiner* — Dean Kramer
(74) *Attorney, Agent, or Firm* — Pepper Hamilton LLP

(57) ABSTRACT

This invention relates to a device (4) for stabilizing a drinks tray, and also to a drinks tray (2) incorporating the device (4). The device (4) finds use in the hospitality industry and enables a tray bearer to support or stabilize the tray (2) from underneath to reduce the risk of the tray (2) tipping and spilling its contents.

20 Claims, 9 Drawing Sheets

TRAY AND DEVICE FOR STABILISING A TRAY

FIELD OF THE INVENTION

The present invention relates to a tray, particularly a tray for carrying drinks, and a device for stabilising the tray when being carried.

BACKGROUND OF THE INVENTION

It is conventional practice in the hospitality industry to use trays for serving drinks and/or food to groups of people. The waiter or waitress typically carries a tray laden with drinks balanced on one hand, leaving his or her second hand free to serve the drinks from the tray to the customer.

Unless the waiter or waitress is experienced in supporting a tray with one hand, there is a constant danger of spillage of drinks or breakage of glassware caused by the tray tipping and the waiter or waitress not being able to react to the tipping force such that the tray remains substantially horizontal. Even the most skilled of serving staff may experience a moment of uncertainty when sliding a filled tray from the counter until they have control of the tray.

It is known to provide trays with flexible straps on the underside of the tray, through which a waiter or waitress can insert their hand. However, such arrangements are cumbersome for the end user, do not provide sufficient control in order to exert a large enough reactive force to counteract a tipping moment, and can require the tray to be controlled with the serving hand in order to extricate the hand from the strap.

It is also known to fix a rigid carrying handle to the underside of a tray, onto which the waiter or waitress can grasp. However, such an arrangement expends considerable energy, causing fatigue, and does not allow efficient stacking of like trays when not in use.

There is a continued need for alternative and preferably improved trays which address at least some of the issues mentioned above.

SUMMARY OF THE INVENTION

According to a first aspect of the invention there is provided a tray comprising a stabilising device, the device comprising:

at least one finger support member;

at least one spacer element connected to the finger support member and to the underside of the tray; wherein in use, the finger support member can move between a closed position in which the finger support member is substantially flush with the underside of the tray and an open position in which the finger support member is spaced from the underside of the tray such that a user can insert at least one finger between the tray and the finger support member.

The spacer element may be connected to the underside of the tray by a base member mounted on the underside of the tray.

The spacer element may be connected to the base member or underside of the tray by means of a first pivotal connection.

The spacer element may be connected to the finger support member by means of a second pivotal connection.

The device may comprise a further spacer element connected to the finger support member and to the underside of the tray.

The further spacer element may be connected to the finger support member by means of a third pivotal connection.

The further spacer element may be connected to the underside of the tray or base member by means of a fourth pivotal connection.

The device may further comprise a slidable element in communication with the underside of the tray.

The fourth pivotal connection may be provided between the further spacer element and the slidable element.

The slidable element may be housed in a recess.

The recess may define a channel in which the slidable element can move.

The spacer element may be elastically deformable and biased in favour of the closed position.

The spacer element may be connected to a central portion of the finger support member.

The finger support member may comprise first and second ends extending from opposite sides of a central portion thereof.

The finger support member may comprise guide means at an edge of the finger support member.

The guide means may comprise at least one arcuate element arcing in a direction away from the underside of the tray.

The components of the device may be integrally formed.

The device may be located in a recess in the underside of the tray.

The underside of the tray and/or the base member may comprise one or more channels for guiding a user's fingers toward the device.

The underside of the tray and/or the slidable element may comprise one or more channels for guiding a user's fingers toward the device.

The underside of the tray and/or the upper side of the tray may be provided with indicator means for indicating to a user the part of the tray from which the stabilising device should be approached. The indicator means may be provided on one or both surfaces of a lip of the tray. The indicator means may be visual and/or tactile. For example, the indicator means may comprise a protrusion from a surface, or a textured surface.

The device may further comprise a retaining element to secure the finger support member in the closed position when not in use.

According to a second aspect of the invention there is provided a stabilising device for attachment to the underside of a tray, comprising:

at least one finger support member;

at least one spacer element configured to be connected to the underside of the tray and connected to the finger support member; wherein the device is suitable for stabilising a tray according to the first aspect of the invention.

The at least one spacer element may be connected to the underside of the tray by a base member integrally formed with the stabilising device.

According to a third aspect of the invention there is provided the use of a tray according to the first aspect of the invention for carrying drinks and/or food.

DETAILED DESCRIPTION OF THE INVENTION

The Tray

The tray may comprise any tray suitable for carrying drinks and/or food. The tray may be formed from any rigid or non-flexible material. Examples of suitable materials include but are not limited to plastics materials, fibre glass, metals or wood. Particularly preferred materials are plastics materials, for example thermoplastic or thermosetting materials, for their durability and low weight. Examples of suitable plastics materials include but are not limited to polypropylene or polycarbonate.

The Stabilising Device

The stabilising device and its components may be formed from any rigid or non-flexible material by thermo-forming or injection moulding techniques. Particularly preferred materials are polycarbonate, polypropylene, polyethylene or nylon.

The stabilising device should be small enough to be mountable onto the underside of a serving tray and of dimensions such that a user can engage the device with his or her hand in a manner described herein.

The stabilising device may be mounted onto the underside of the tray by any suitable bonding or welding means during, or following, manufacture of the tray. For example, the device may be mounted onto the underside of the tray using an adhesive, for example, an epoxy resin adhesive. Alternatively the device may be mounted onto the underside of the tray by snap-fit means. Preferably, the device is located substantially adjacent the centre of the tray.

Alternatively, the tray and stabilising device may be integrally formed by, for example, injection moulding of a plastics material.

Preferably the device is located in a recess on the underside of the tray. For example, the device may be flush with the surface of the underside of the tray. Alternatively, the depth of the recess may be greater than the depth of the device such that the device is completely contained within the recess and is no longer flush with the surface of the underside of the tray. In either arrangement, the tray will be stable when it is placed on, for example, a bar counter and is being loaded with drinks. This arrangement also enables multiple trays according to the present invention to be stacked neatly on top of one another.

The region surrounding the device on the underside of the tray may comprise a roughened or textured surface providing additional grip for the fingers and thumb of the tray bearer. In a further embodiment, a non-slip layer is provided on the exposed surfaces of the device. The non-slip layer may be a layer of rubber. The rubber may be applied by over-moulding in injection moulding or by spray-application.

The stabilising device may comprise a base member for mounting or mounted on the underside of the tray. The base member may be located in a recess on the underside of the tray. The base member may be a point of connection between the stabilising device and the underside of the tray. The base member may comprise a recess in which elements of the device can be housed. Alternatively, the base member and the rest of the stabilising device may be located substantially in the same recess on the underside of the tray.

The surface of the base member may comprise a roughened or textured surface providing additional grip for the fingers and thumb of the tray bearer.

The base member may be mounted on the underside of the tray by any suitable means. For example, the base member may be mounted on the underside of the tray by snap-fit means. The base member may be integrally formed with the rest of the stabilising device. In the embodiment where the device is integrally formed with the tray, the base member may be part of the tray.

The device comprises a finger support member against which a user can brace his or her fingers. Preferably the finger support member comprises an elongate body with first and second ends extending from opposite sides of a central portion. Alternatively, the finger support member may be a substantially circular disc. The finger support member may be planar. The underside of the finger support member may be contoured to accommodate a user's fingers.

The device also comprises at least one spacer element connected to the underside of the tray. The at least one spacer element may be formed from any substantially rigid material. In an alternative embodiment, the at least one spacer element may be formed from an elastically deformable material. The at least one spacer element may be connected to the underside of the tray by any suitable means, such as any bonding or welding means. The connection may be a direct or indirect connection. In the embodiment where the at least one spacer element is indirectly connected to the underside of the tray, the at least one spacer element may be connected to a base member mounted on the underside of the tray. The at least one spacer element may be connected to the base member by means of a first pivotal connection. Alternatively, the at least one spacer element may be directly connected to the underside of the tray. The at least one spacer element may be connected to the underside of the tray by means of a first pivotal connection.

Advantageously, the at least one spacer element and base member are integrally formed from the same material. In this embodiment, the pivotal connection may comprise a fold, notch or groove formed between the at least one spacer element and the base member. However, the base member and the at least one spacer element may be separately formed, in which case other pivotal connections, for example pivot pins, may be used.

The at least one spacer element is connected to the finger support member. The at least one spacer element may be connected to a central portion of the finger support member. The at least one spacer element may be connected to the finger support member by means of a second pivotal connection. The at least one spacer element may be pivotally connected to the finger support member and pivotally connected to the underside of the tray.

Advantageously, the at least one spacer element and finger support member are integrally formed from the same material. In this embodiment, the pivotal connection may comprise a fold, notch or groove formed between the at least one spacer element and the finger support member. However, the finger support member and the at least one spacer element may be separately formed, in which case other pivotal connections, for example pivot pins, may be used.

When the at least one spacer element and the finger support member are integrally formed from the same material, or when the base member and the at least one spacer element are integrally formed from the same material, or when the base member, the at least one spacer element and the finger support member are integrally formed from the same material, suitable examples of materials include but are not limited to polypropylene, polyethylene or nylon. Such an integrated component can be formed by any known process, for example injection moulding.

The stabilising device may further comprise a slidable element disposed on the underside of the tray. The slidable element may be in communication with the underside of the tray. The slidable element may be housed in a recess. The recess may be defined in part by the recess in which the base member is located. The base member may define at least in part the recess in which the slidable element may be housed. The recess may be defined at least in part by one or more retaining channels disposed on the underside of the tray. The one or more retaining channels may engage with the slidable element such that the slidable element is restricted to bidirectional movement (i.e. backward and forward) in the plane of the tray. The slidable element may be in constant communication with the underside of the tray.

The device may also comprise a further spacer element connected to the finger support member. The further spacer element may be a second spacer element or a third spacer element. The further spacer element may be connected to a central portion of the finger support member. The further spacer element may be connected to the finger support member by means of a third pivotal connection. Advantageously, the further spacer element and finger support member are integrally formed from the same material. In this embodiment, the pivotal connection may comprise a fold, notch or groove formed between the further spacer element and the finger support member. However, the finger support member and the further spacer element may be separately formed, in which case other pivotal connections, for example pivot pins, may be used.

The further spacer element may be connected to the underside of the tray. The connection may be a direct or indirect connection. In the embodiment where the further spacer element is indirectly connected to the underside of the tray, the further spacer element may be connected to the slidable element which is in communication with the underside of the tray. In this embodiment, a fourth pivotal connection may be provided between the further spacer element and the slidable element. Alternatively, the further spacer element may be directly connected to the underside of the tray. The further spacer element may be connected to the underside of the tray by means of a fourth pivotal connection. The further spacer element may be pivotally connected to the finger support member and pivotally connected to the slidable member.

The finger support member may be provided with guide means at an edge of the finger support member. The guide means preferably comprises at least one arcuate element arcing in a direction away from the underside of the tray. The guide means may serve to guide a tray bearer's index finger and middle finger either side of the spacer element and underneath the finger support member.

In the embodiment comprising the finger support member, the at least one spacer element, and also one or more of a slidable portion, a further spacer element and guide means, these may be integrally formed from the same material. The base member may also be integrally formed with the finger support member, the at least one spacer element, and also one or more of a slidable portion, a further spacer element and guide means. The complete stabilising device may be integrally formed. Any rigid material which can accommodate hinges in the form of folds as described previously may be used. Suitable examples include but are not limited to polypropylene, polyethylene or nylon. Such an integrated component can be formed by any known process, for example injection moulding.

Once produced, such a component can be mounted on the underside of a tray by locating the slidable element in a channel defined by a base member mounted on the underside of the tray, and by providing a pivotal connection between the further spacer element and the underside of the tray or between the further spacer element and the base member. The slidable element may be integrally formed with the at least one spacer element and located within the base member prior to the base member being mounted on the underside of the tray. The pivotal connection between the further spacer element and the underside of the tray or between the further spacer element and the base member may be formed by welding or bonding of the two materials.

In an alternative embodiment, an integrally formed stabilising device can be mounted on the underside of the tray by locating the slidable element in one or more retaining channels disposed on the underside of the tray, and locating the base member of the integrally formed stabilising device into a recess also provided on the underside of the tray. The base member may be secured in position by any previously discussed means, such as snap-fit means.

The device may further comprise a cover which can be secured onto the base member by any means such as snap-fit or bonding means. The cover may be located such that it substantially covers the slidable element when in the closed position.

The stabilising device may be provided with a retaining element to secure the finger support member in the closed position. The retaining element may be disposed on the base member. Alternatively, the retaining element may be disposed on the cover. The retaining element may be adapted to engage with the pivotal connection between the slidable element and the at least one spacer element. In the embodiment wherein the pivotal connection between the slidable element and the at least one spacer element is a fold in the material, the retaining element comprises a projection configured to engage with the fold.

In the embodiment wherein the at least one spacing element is elastically deformable, the spacing element may be biased in favour of the closed position. In such an embodiment, the finger support member will be naturally retained in, or biased towards, the closed position. Further, the stabilising device may possess a single spacer element and optionally a single finger support member.

Optionally, the underside of the finger support member may be provided with a layer of cushioning material. In use, the back of a tray bearer's fingers will contact the underside of the finger support member. The presence of the cushioning material provides extra comfort.

Use of a Tray Comprising the Stabilising Device

In use, a stabilising device according to the present invention provides a tray bearer with much greater control of the tray so that any unexpected tipping forces of the tray about its pivot point can be reacted to quickly. In this manner, the tray bearer can safely transport drinks or food to a table with a reduced risk of the contents of the tray being spilled.

Typically, a tray will be loaded with drinks while residing on a bar counter. The waiter or waitress will then slide the filled tray from the counter with one hand, with the other hand receiving and supporting the load of the tray from underneath.

Since the waiter or waitress will not be able to see the underside of the tray when it is resting on the counter, the tray may be provided with indicator means on a surface of the tray. The indicator means may be on any surface of the tray which a user can see or contact when the tray is resting on a counter. The indicator means may be visual or tactile. The waiter or waitress can thus easily align the tray on the bar counter with the indicator means closest to himself or herself, or in any other preferred orientation and know that his or her hand will be correctly positioned to be inserted into the stabilising device.

As the tray is being slid from the counter to the supporting hand, the waiter's or waitress' index finger and middle finger can insert into the device either side of the spacer element. This process may be facilitated first of all by first and second channels which may be provided in the surface of the underside of the tray and/or in the surface of the base member which serve to align the user's fingers ready for insertion into the device. In an alternative embodiment, the underside of the tray and the slidable element may be provided with first and second channels which serve to align the user's fingers. Once the user's fingers reach the finger support member and its first and second ends, guide means provided on an edge of the first and second ends guide the user's fingers either side of the spacer element and under the first and second ends. Through this action, the waiter's or waitress' fingers cause the device to move from a closed position to an open position, wherein the finger support member is spaced from the underside of the tray.

References to a closed position of the device, to a closed position of the slidable element and to a position in which the finger support member and its first and second ends are substantially flush with the underside of the tray may be taken to mean those positions in which the central portion and first and second ends of the finger support member are in contact with or in close proximity to the underside of the tray.

References to an open position of the device, to an open position of the slidable element and to a position in which the central portion of the finger support member and its first and second ends are spaced from the tray may be taken to mean those positions in which the central portion of the finger support member and its first and second ends are no longer in contact with or in close proximity to the underside of the tray. For example, the spacer elements may form an angle, for example an oblique angle or a right angle with the finger support member, the underside of the tray or with the slidable element. In such positions, for example, a tray bearer's index and middle fingers can be inserted either side of the spacer element and between the underside of the tray and the first and second ends of the finger support member.

Once the tray bearer has inserted his or her index and middle fingers either side of the spacer element and caused the device to move to an open position, the backs of the index and middle fingers will contact the underside of the first and second ends of the finger support member. This intimate contact, together with the intimate contact of the tips of all four fingers and thumb with the underside of the tray or with the base member, enables the tray bearer to brace his or her hand against the first and second ends of the finger support member and against the underside of the tray.

This braced position provides the waiter or waitress with greater control over the tray and its contents. Thus, the braced position allows the waiter or waitress to exert a reactive, opposing force to any tipping force of the tray.

A stabilising device in accordance with the invention may be retro-fitted to any existing tray, immediately providing a waiter or waitress with a greater degree of control over the tray. Furthermore, the stabilising device folds away neatly and allows like trays to be stacked on top of each other, or to be placed on a bar counter yet providing a stable surface onto which drinks can be loaded.

In addition, the stabilising device is discreet when in use, such that the waiter or waitress appears to be effortlessly carrying a loaded tray and yet managing not to upset its contents. As a result of the device folding away into its closed position, a tray comprising such a stabilising device can be carried in the normal manner, should serving staff not wish to use the device.

BRIEF DESCRIPTION OF THE DRAWINGS

The invention will now be described, by way of example only and without limitation, with reference to the accompanying drawings, in which.

DETAILED DESCRIPTION OF THE DRAWINGS

Figure 1:
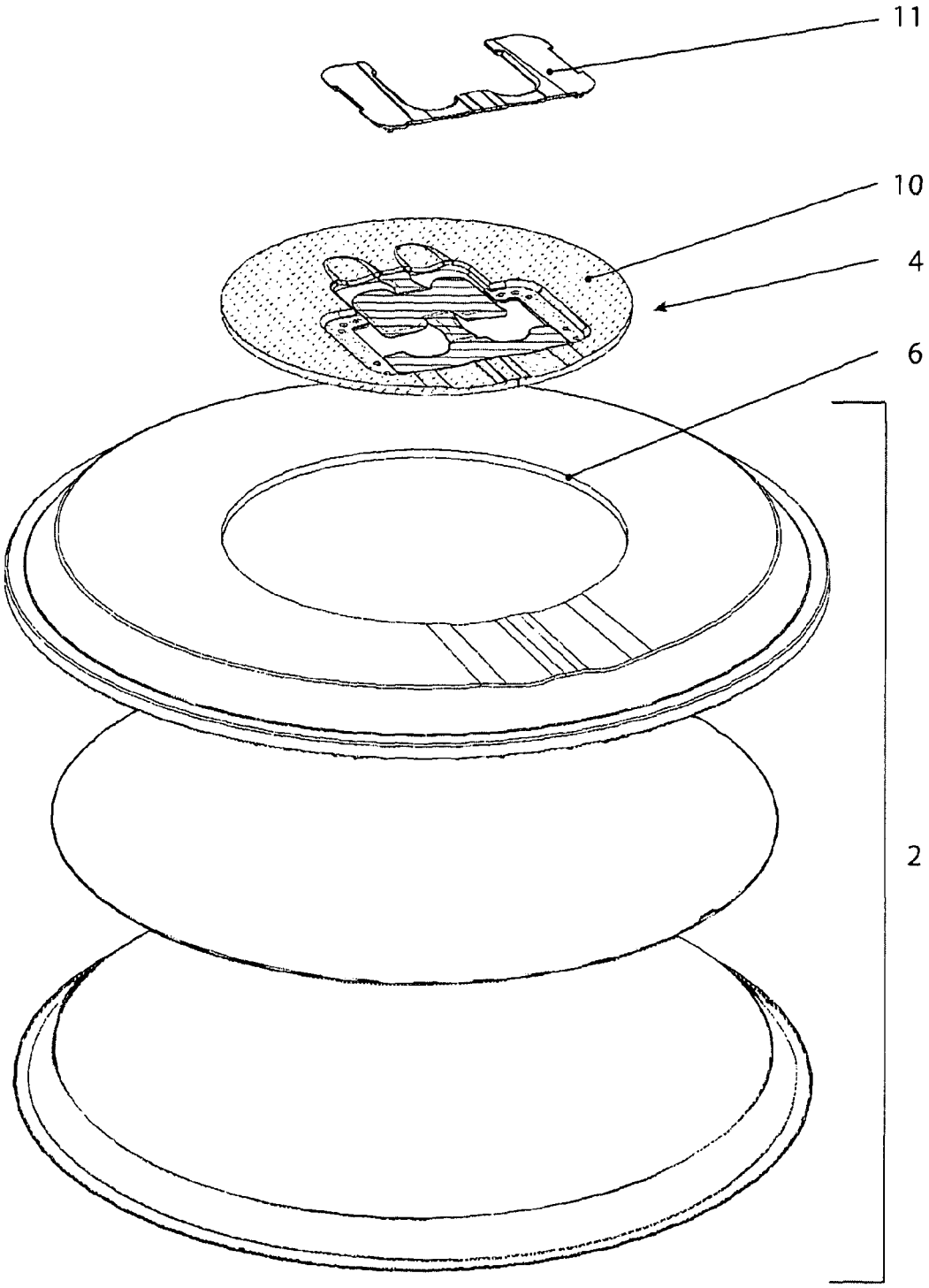
FIG. 1 illustrates an exploded view of one possible construction of a tray comprising a device according to the present invention.

FIG. 1 shows an exploded view of one possible construction of a tray according to the present invention. The components of the tray are indicated generally at 2. A stabilising device, shown generally at 4 comprises a base member 10 to be mounted in a recess 6 on the underside of the tray 2. A cover 11 is provided.

Figure 2:
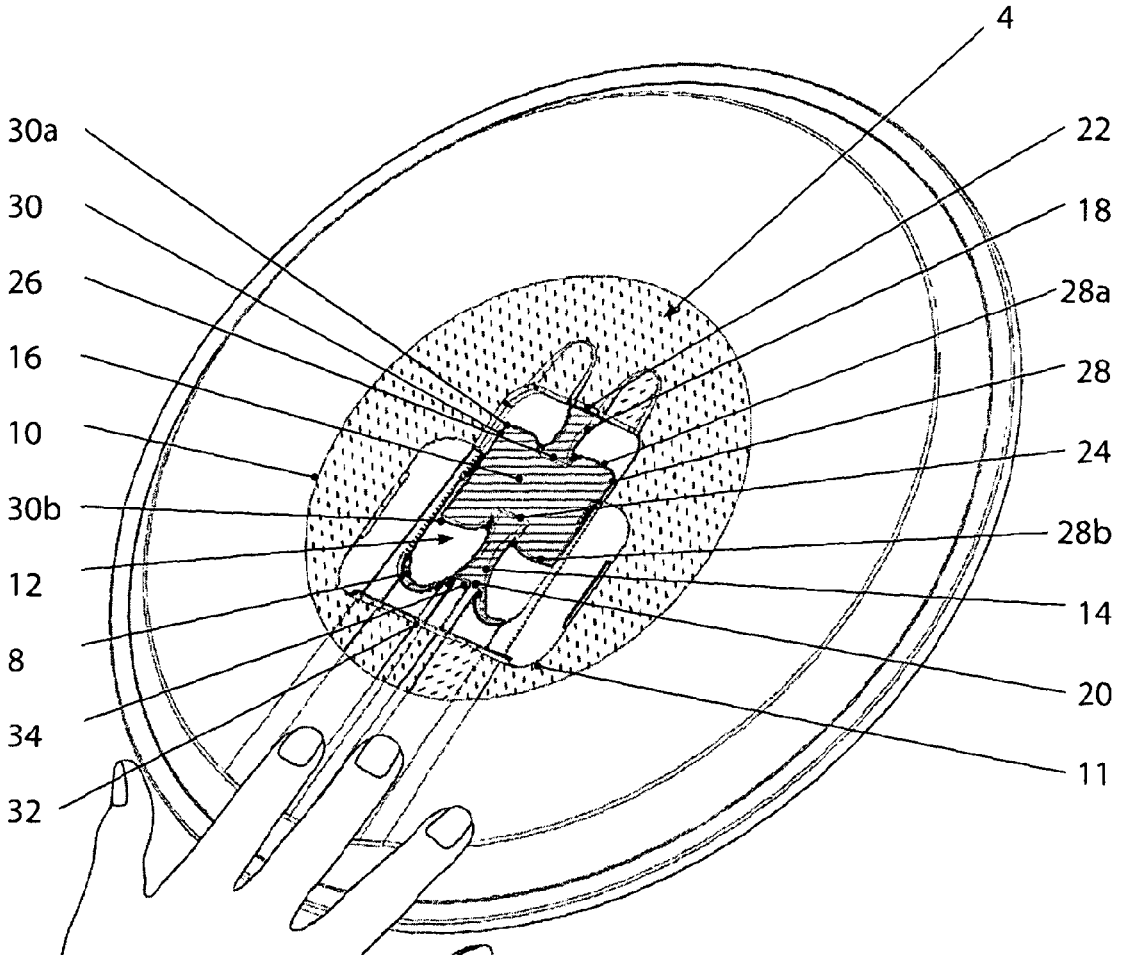
FIG. 2 illustrates the underside of a tray comprising a device according to the present invention, in which the device is in a closed position.

FIG. 2 shows the underside of a tray comprising a stabilising device, shown generally at 4, in accordance with the invention. The device 4 comprises a slidable element 8, the outer edge of which is just visible in the Figure. The base member 10 defines a recess in which the slidable element 8 is housed. The recess defines a channel to restrict the slidable portion to backward and forward motion only with no, or only minimal, lateral movement possible.

Slidable element 8 is integrally formed with a spacer element 14. Spacer element 14 is pivotally connected to slidable element 8 by way of fold, notch or groove 20. A second spacer element 18 is pivotally connected to base member 10 at pivot point 22. The pivot is formed by any suitable bonding or welding means known in the art. In the particular embodiment shown, the edges of first and second spacer elements 14, 18 which contact a user's fingers are concave for better engagement. However, first and second spacer elements 14, 18 may also be straight-sided.

Cover 11 comprises a central portion 32 which extends over slidable element 8 and terminates in retaining element 34. In this particular embodiment, retaining element 34 is in the form of a projection or ridge which engages with fold, notch or groove 20 when the device is in the closed position.

A further pivot 24, in the form of a fold, notch or groove in the material, is provided between spacer element 14 and a central portion 16 of finger support member 12. In the particular embodiment shown, yet another pivot 26 in the form of a fold, notch or groove in the material is provided between the central portion 16 of finger support member 12 and second spacer element 18.

Finger support member shown generally at 12 comprises first and second ends 28, 30 extending from opposite sides of central portion 16 of finger support member 12. First and second ends 28, 30 comprise elongate members and are provided with guide means 28*a*, 28*b*, 30*a* and 30*b*. Guide means 28*a*, 28*b*, 30*a* and 30*b* are in the form of arcuate elements extending from first and second ends 28, 30, arcing in a direction away from the underside of the tray.

In this closed position, first and second spacer elements 14, 18 and first and second ends 28, 30 and central portion 16 of finger support member 12 are substantially co-planar to each other, to slidable portion 8, and to the underside of tray 2, and are in contact with the underside of the tray.

Figure 3:
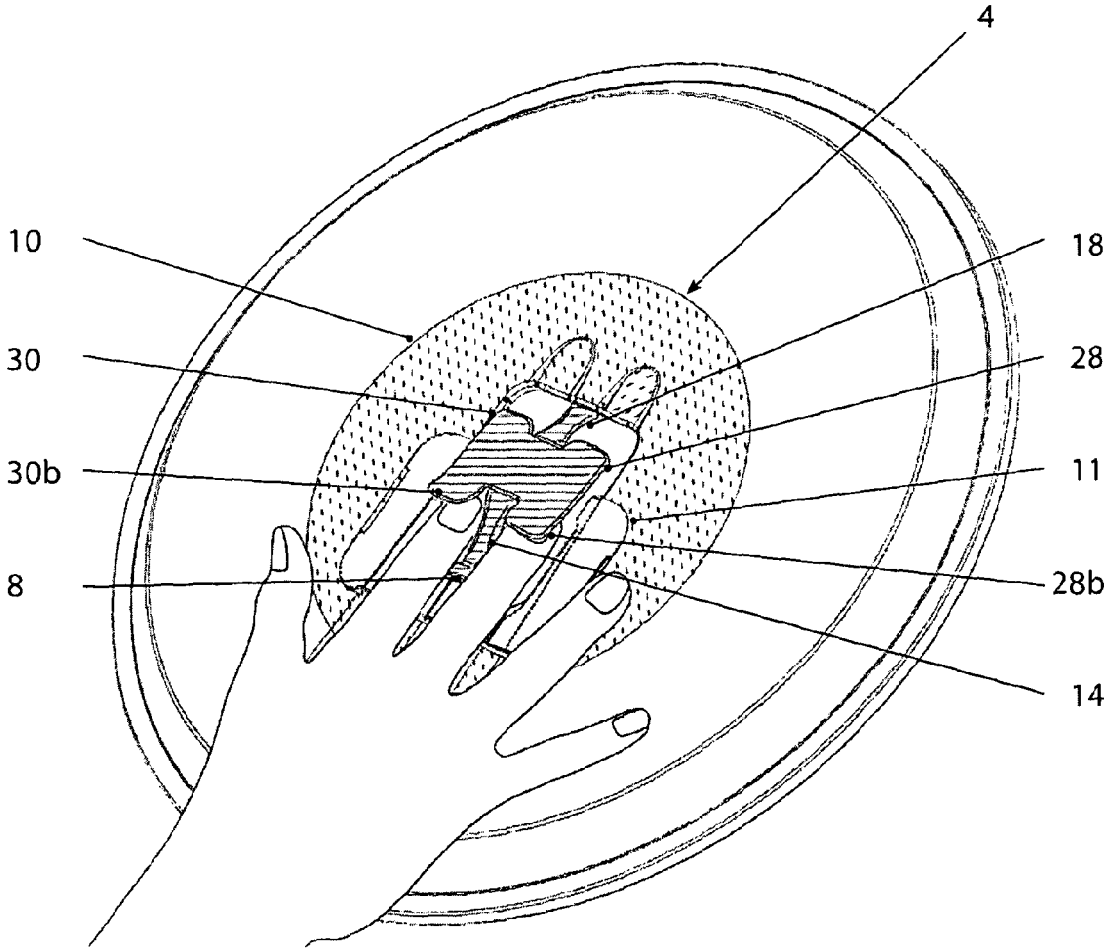
FIG. 3 illustrates the underside of a tray comprising a device according to the present invention, in which a user's index and middle fingers have begun to engage with the device.

As can be more clearly seen in FIG. 3, guide means 28*b* and 30*b* serve to guide a tray bearer's index and middle fingers either side of the spacer element 14 and underneath first and second ends 28, 30 of finger support member 12 thereby ensuring that the tray bearer engages the device 4 smoothly and doesn't encounter any resistance.

Figure 4:
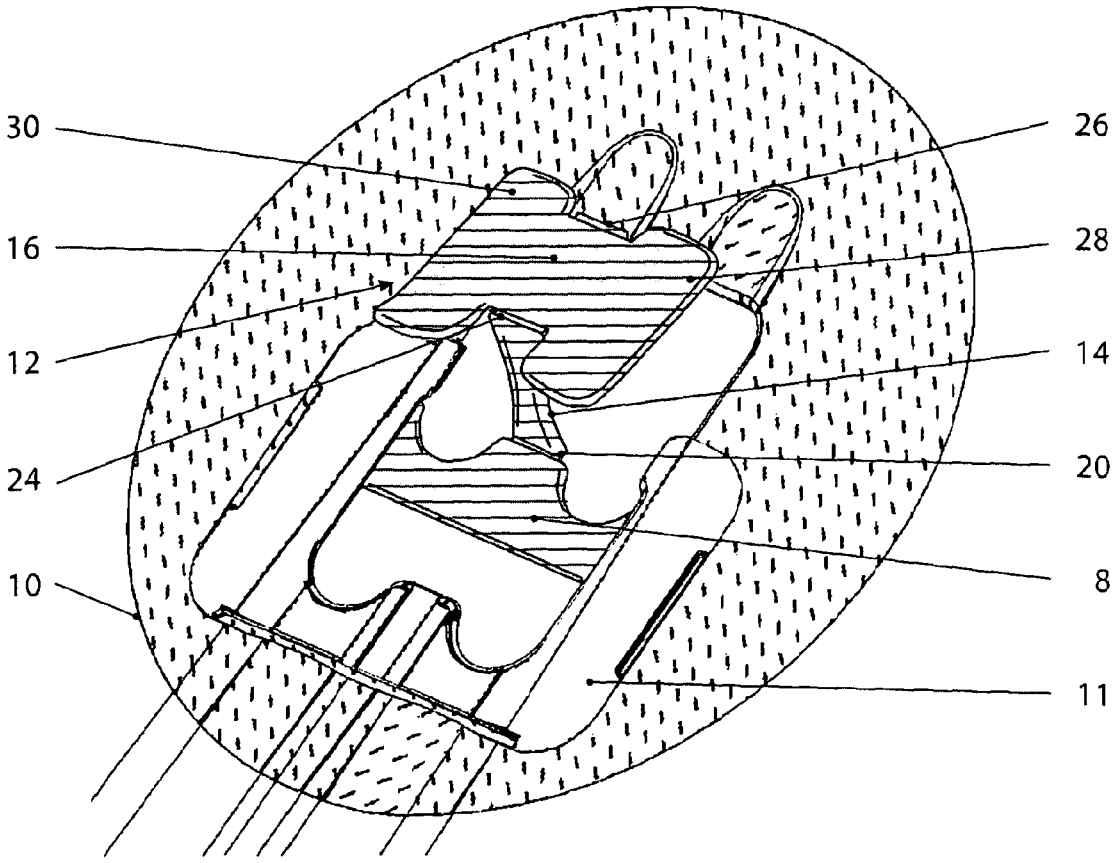
FIG. 4 illustrates a device according to the present invention, in which the device is in an open position.
Figure 5:
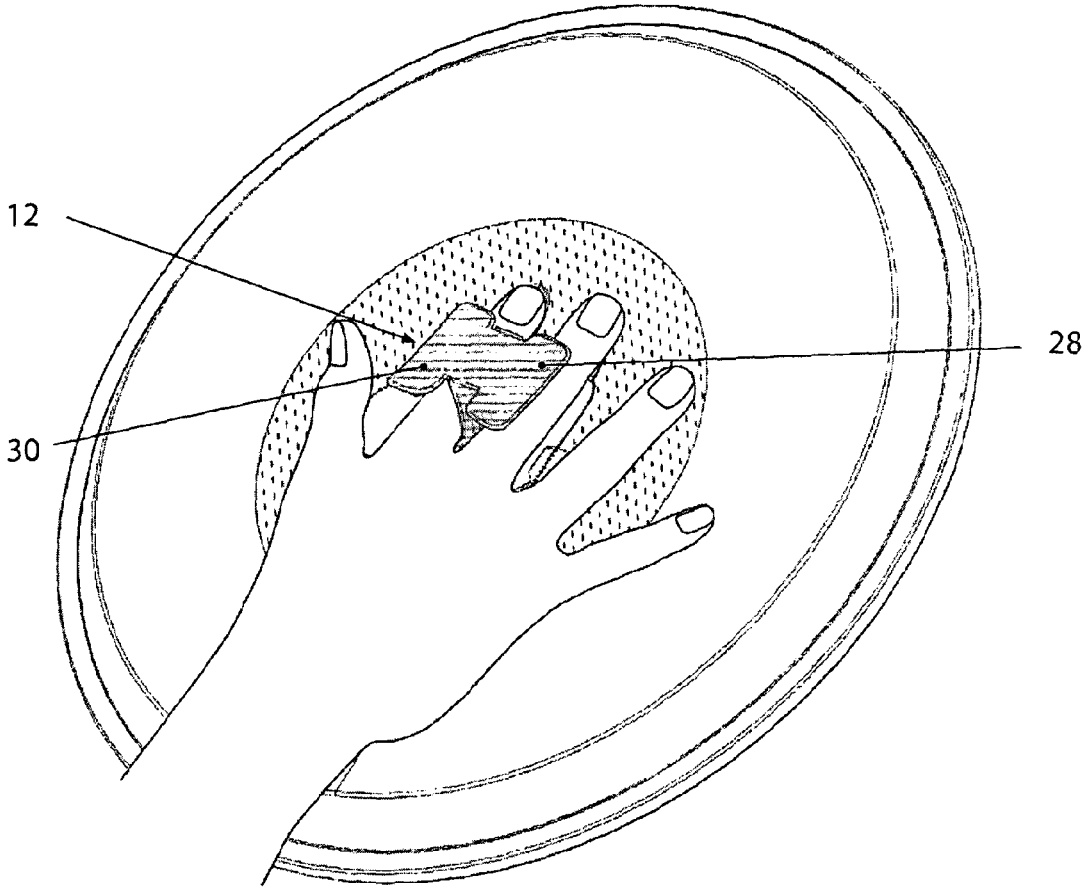
FIG. 5 illustrates the underside of a tray comprising a device according to the present invention, in which a user's fingers have fully engaged with the device.

By engaging the device 4 in this manner, the tray bearer causes device 4 to move from a closed position (FIG. 2) to an open position, as indicated in FIG. 4 (no hand shown) or FIG. 5 (hand shown).

As indicated in FIG. 4, slidable element 8 has moved, in the direction of insertion, from its closed position in which it is housed underneath cover 11, to its open position. In doing so, and as a result of pivots 20, 22 (not visible), 24 and 26, slidable element 8 has caused first and second spacer elements 14, 18 (not visible) to form angles with finger support member 12, slidable portion 8 and the underside of the tray.

In this open position, central portion 16 and first and second ends 28, 30 of support member 12 have become spaced from the underside of the tray by a distance approximately equal to the lengths of first spacer element 14 and second spacer element 18 (not visible). As can be seen from FIG. 5, this dimension is such that a person's fingers can be accommodated under first and second ends 28, 30 of finger support member 12.

The first and second ends 28, 30 of finger support member 12 which engage with the backs of the user's fingers, are able to self align with the user's fingers due to the four pivots 20, 22, 24, 26 and the sliding action of slidable element 8. This arrangement spreads the load over as broad an area as possible, providing maximum possible comfort for the user, and also provides a broad face against which the user can brace his or her hand in order to resist the tipping loads.

Advantageously, due to the pivotal connections 20, 22, 24, 26, the slidable element can slide to its open position, and the device opens or unfolds in the direction of insertion. Accordingly, the user meets no resistance and can engage with the device smoothly.

The user can very easily disengage from the device, either by withdrawing the fingers in the opposite direction to that in which the fingers were originally inserted, or by simply parting his or her index and middle fingers beyond the outer edges of the first and second ends 28, 30 of finger support member 12. The four-pivot sliding and folding system allows the user's hand to be withdrawn easily without any jamming or excess friction.

Figure 6:
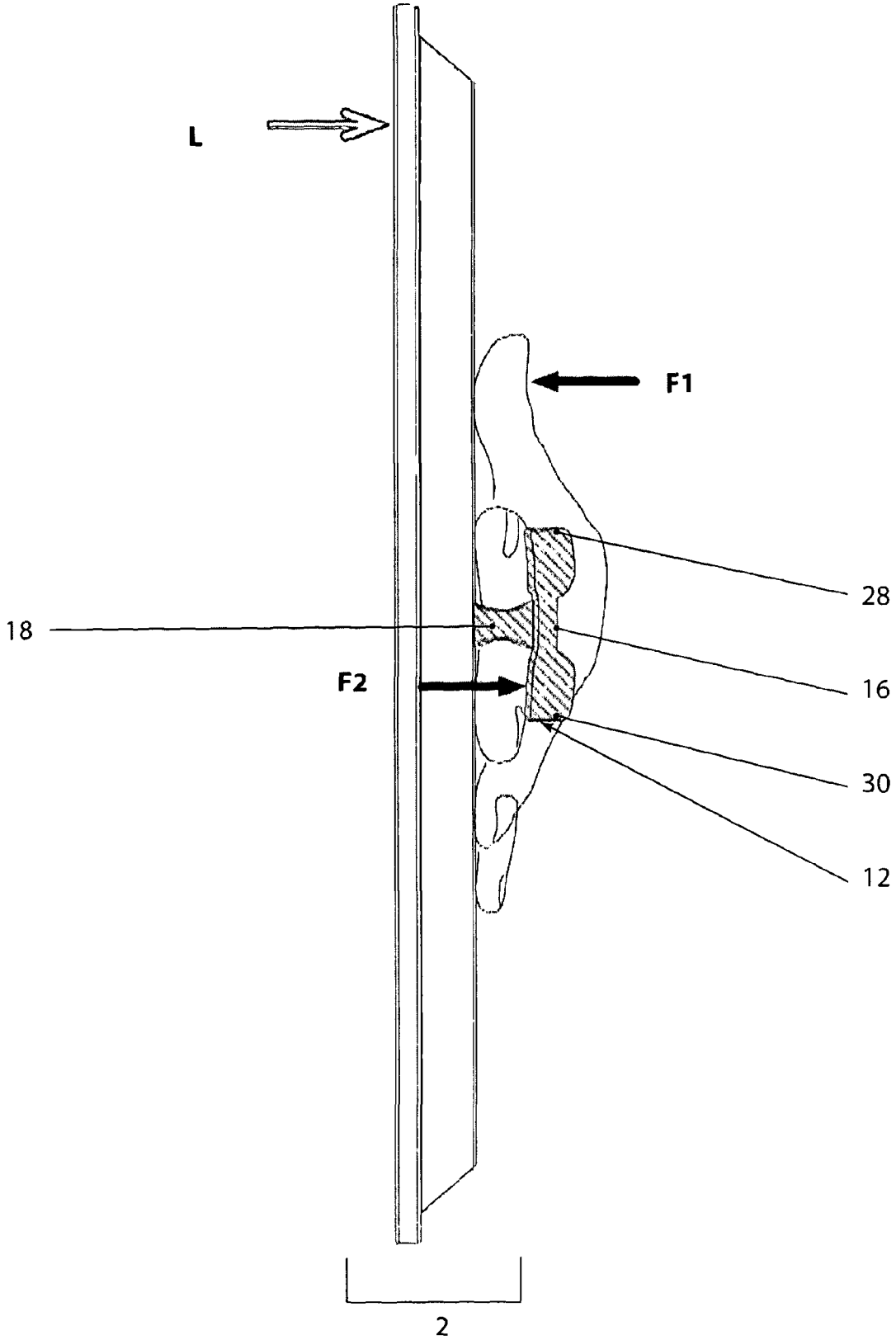
FIG. 6 illustrates a side view of a tray according to the present invention in use and indicates the forces at work.

FIG. 6 shows the tray 2 and device in use, and indicates in particular the forces which can be applied to allow the user to react against overhanging tipping loads on the top surface of the tray.

As can be seen in FIG. 6, the user's index and middle fingers are positioned either side of the second spacer element 18 and between the underside of the tray 2 and the first and second arms 28, 30 of the support member 12 which are either side of central portion 16. The user's hand is able to adopt a braced position in which the fingertips and tip of the thumb contact the underside of the tray 2 or base member 10 (not shown), and the backs of the index and middle fingers contact the first and second ends 28, 30 of finger support member 12.

In the event of a tipping load L being applied to the upper surface of the tray, for example from an off-centre weight bias, the user has two reaction points and resulting reactive forces. The first of these is an upward force from the underside of the tray and as close as possible to the original tipping load. The second is a downward force from the back of the finger tip against the first or second end of the finger support member on the side of the device furthest away from tipping load L. In this example, the first reactive force is an upward reaction F1 from the tip of the thumb and the second reactive force is a downward reaction F2 from the back of the middle finger against second end 30. This also works in reverse when an upwards overhanging load is applied, for example an accidental knock from underneath.

Figure 7:
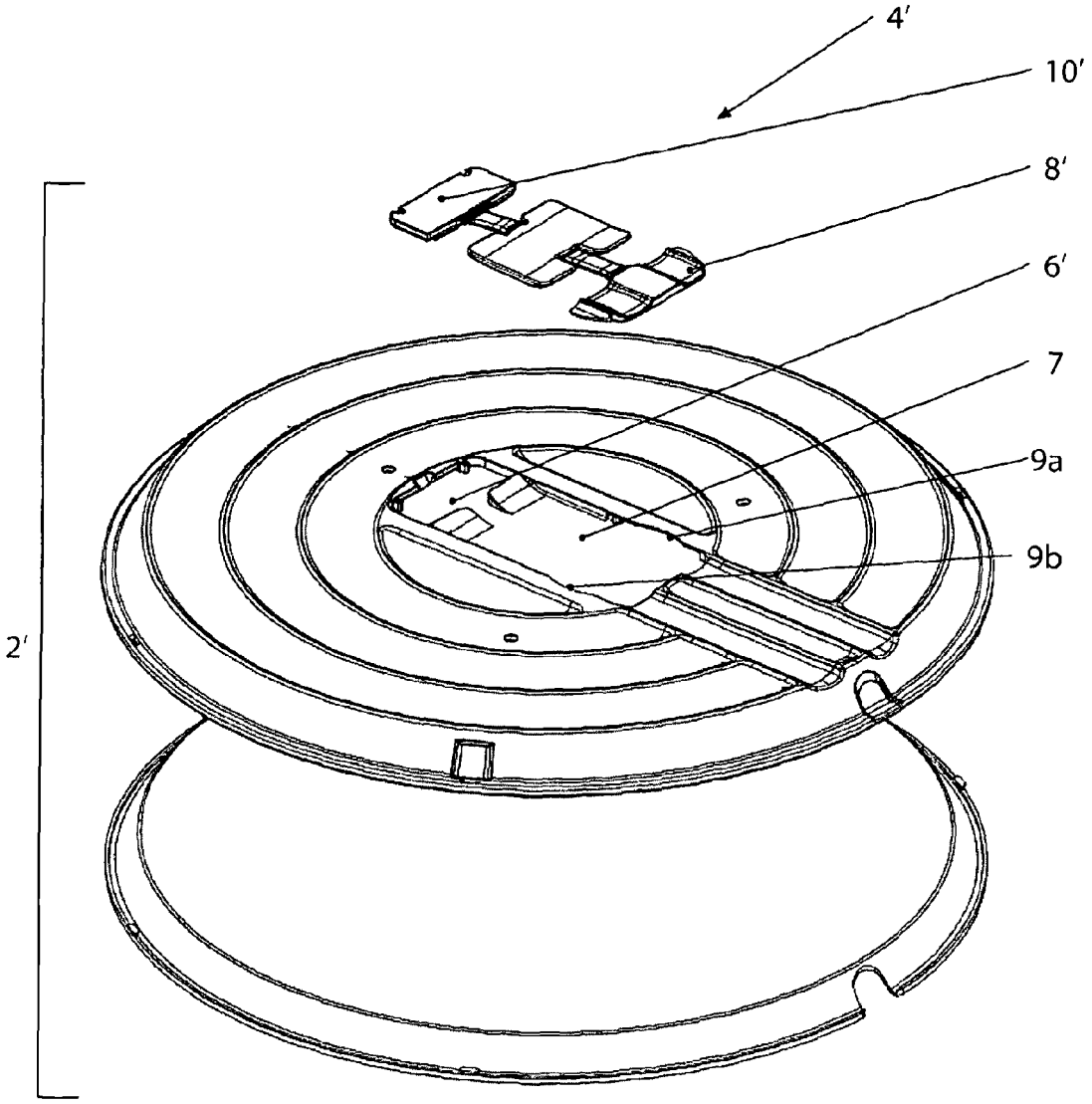
FIG. 7 illustrates an exploded view of a further construction of a tray comprising a device according to the present invention.
Figure 8:
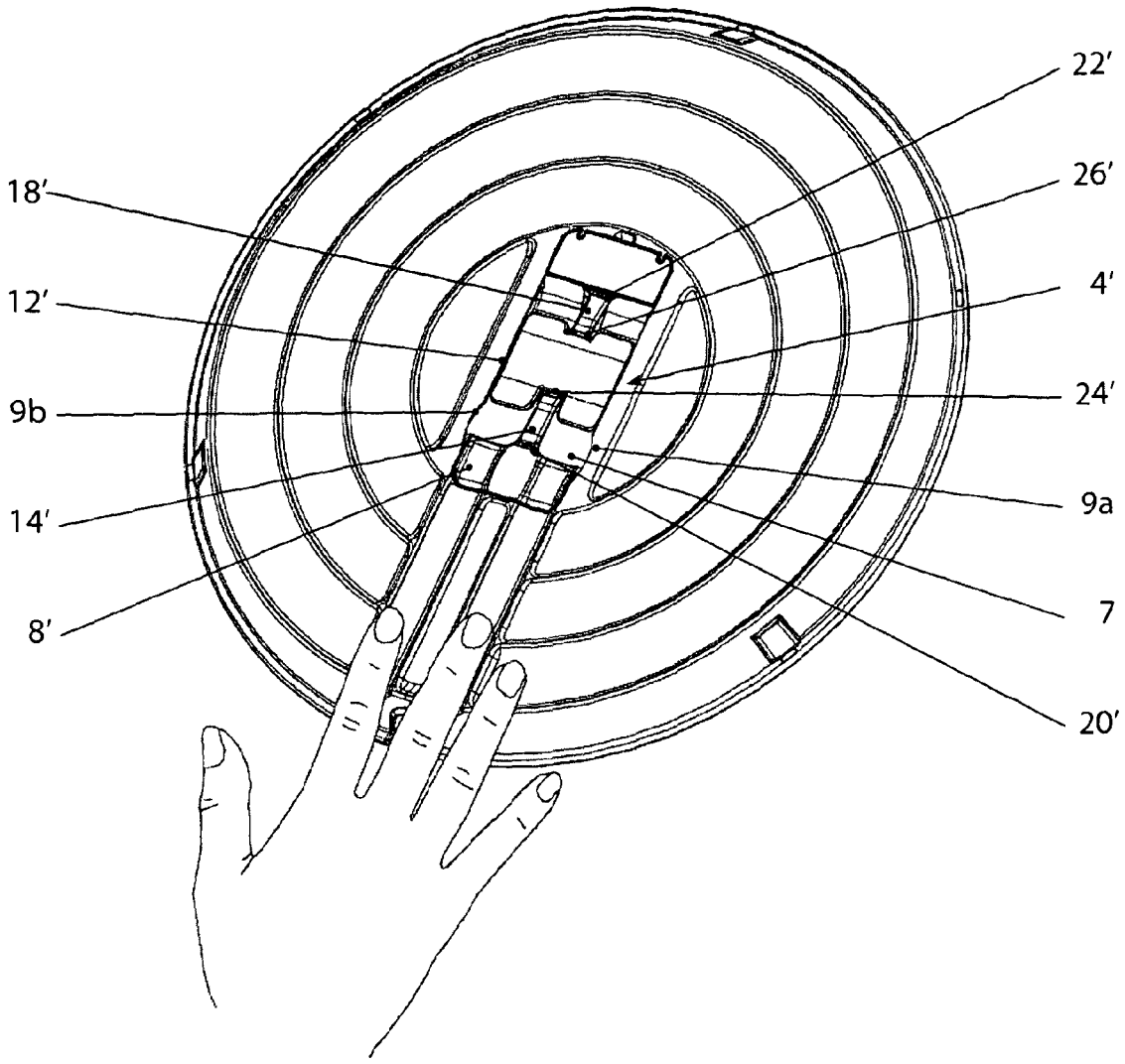
FIG. 8 illustrates the underside of the tray of FIG. 7, in which the device is in a closed position.
Figure 9:
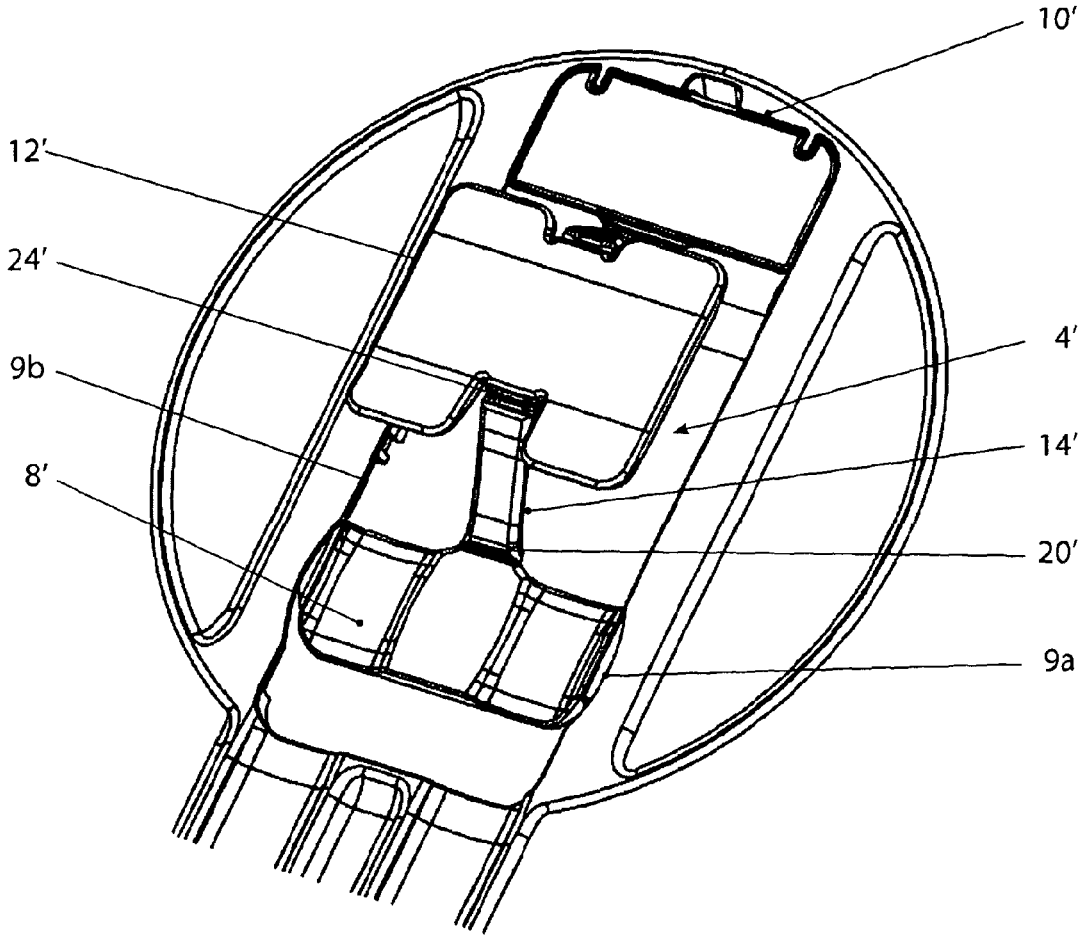
FIG. 9 illustrates the underside of the tray of FIG. 7, in which the device is in an open position.

FIGS. 7 to 9 illustrate an alternative embodiment of the present invention in which the base member does not enclose the rest of the stabilising device and the slidable element is located in a recess provided on the underside of the tray rather than in the base member. However, the device depicted in FIGS. 7 to 9 operates in a similar manner as the device in FIGS. 1 to 6.

FIG. 7 shows an exploded view of a second embodiment of a tray according to the present invention. The components of the tray are indicated generally at 2'. An integrally formed stabilising device, shown at 4' comprises a base member 10' to be mounted in a recess 6' on the underside of the tray 2'. Tray 2' comprises a base part to which the stabilising device 4' can be fixed, and an insert part which inserts into the base part and onto which the drinks may be placed. Alternatively, the base part and the insert part may be integrally formed.

FIGS. 8 and 9 show the underside of a tray comprising a stabilising device, shown at 4', in accordance with the invention, with the device in closed (FIG. 8) and open (FIG. 9) positions.

As can be seen in FIG. 7, in the vicinity of recess 6' is provided a second recess 7, for engaging slidable element 8'. Recess 7 is defined in part by opposing retaining channels 9*a* and 9*b* which receive slidable element 8', thereby restricting slidable element 8' to backward and forward motion only, with no, or only minimal, lateral movement possible, as shown in FIGS. 8 and 9. The primary function of recess 6' and recess 7 is to provide a substantially flat underside of the tray comprising the stabilising device so that it may be placed on, for example, a bar counter so that drinks may be placed upon the tray. Accordingly, recess 6' and recess 7 may conjoin to form part of a larger recess which is provided with means for securing the base member in place and with retaining channels 9*a* and 9*b*.

In use, the device of this second exemplification operates in a similar manner as the device of FIGS. 1 to 6. That is to say, the user's fingers approach stabilising device 4' using channels provided in the underside of the tray as a guide to correct finger positioning. Once the user's fingers engage with device 4', continued movement of the user's hand in the same direction, with insertion of two fingers between the tray and finger support member 12' with one finger either side of first and second spacer elements 14' and 18' causes the device to move from a closed position to an open position in which finger support member 12' is spaced from the underside of the tray by a distance approximately equal to the lengths of the first and second spacer elements 14' and 18'.

Movement of the device from the closed position to the open position is again facilitated by (i) movement of the slidable element 8' (again, in the direction of hand movement) along the recess defined by retaining channels 9*a* and 9*b*; and (ii) the series of pivots 20', 22', 24' and 26'.

As with the exemplification described in connection with FIGS. 1 to 6, a user can engage and brace his or her hand against the stabilising device in the open position so that tipping loads can be resisted.

The invention claimed is:

1. A tray comprising a stabilising device, the device comprising:

at least one finger support member;

at least one spacer element connected to the finger support member and to the underside of the tray; and a slidable element in communication with the underside of the tray, wherein the finger support member is configured to move between a closed position in which the finger support member is substantially flush with the underside of the tray and an open position in which the finger support member is spaced from the underside of the tray to enable at least one finger of a user to be inserted between the tray and the finger support member.

2. The tray according to claim 1, wherein the at least one spacer element is connected to the underside of the tray by a base member mounted on the underside of the tray.

3. The tray according to claim 1, wherein the at least one spacer element is connected to the underside of the tray by means of a pivotal connection.

4. The tray according to claim 1, wherein the at least one spacer element is connected to the finger support member by means of a pivotal connection.

5. The tray according to claim 1, wherein the at least one spacer element comprises first and second spacer elements connected to the finger support member and to the underside of the tray.

6. The tray according to claim 5, wherein the second spacer element is connected to the finger support member by means of a pivotal connection.

7. The tray according to claim 5, wherein the second spacer element is connected to the underside of the tray by means of a pivotal connection.

8. The tray according to claim 7, wherein a pivotal connection is provided between the at least one spacer element and the slidable element.

9. The tray according to claim 1, wherein the slidable element is housed in a recess.

10. The tray according to claim 9, wherein the recess defines a channel in which the slidable element can move.

11. The tray according to claim 1, wherein the at least one spacer element is elastically deformable and biased in favour of the closed position.

12. The tray according to claim 1, wherein the at least one spacer element is connected to a central portion of the finger support member.

13. The tray according to claim 1, wherein the finger support member comprises first and second ends extending from opposite sides of a central portion thereof.

14. The tray according to claim 1, wherein the finger support member comprises guide means at an edge of the finger support member.

15. The tray according to claim 14, wherein the guide means comprise at least one arcuate element arcing in a direction away from the underside of the tray.

16. The tray according to claim 1, wherein the device is integrally formed.

17. The tray according to claim 1, wherein the device is located in a recess in the underside of the tray.

18. The tray according to claim 1, wherein the underside of the tray comprises one or more channels configured to guide a user's fingers toward the device.

19. The tray according claim 1, wherein the slidable element comprises one or more channels configured to guide a user's fingers toward the device.

20. The tray according to claim 1, wherein the device further comprises a retaining element to secure the finger support member in the closed position when not in use.

* * * * *